United States Patent [19]

Kanemaru

[11] Patent Number: 4,794,733

[45] Date of Patent: Jan. 3, 1989

[54] VEHICLE DOOR APPARATUS

[75] Inventor: Yukihiro Kanemaru, Hiroshima, Japan

[73] Assignee: Mazda Motor Corporation, Hiroshima, Japan

[21] Appl. No.: 902,521

[22] Filed: Sep. 2, 1986

[30] Foreign Application Priority Data

Sep. 5, 1985 [JP] Japan ..... 60-194770

[51] Int. Cl.[4] ..... E05F 11/38

[52] U.S. Cl. ..... 49/348; 49/346; 49/350; 49/375

[58] Field of Search ..... 49/350, 348, 375, 376, 49/363, 346, 349, 347

[56] References Cited

U.S. PATENT DOCUMENTS

| | | | |
|---|---|---|---|
| 2,822,215 | 2/1958 | Blanton et al. | 49/425 |
| 4,418,498 | 12/1983 | Wanlass et al. | 49/425 |
| 4,593,494 | 6/1986 | Ono et al. | 49/348 |

FOREIGN PATENT DOCUMENTS

| | | | |
|---|---|---|---|
| 0007851 | 2/1980 | European Pat. Off. | 49/349 |
| 0644987 | 4/1937 | Fed. Rep. of Germany | 49/348 |
| 57-29018 | of 1982 | Japan . | |
| 0749110 | 5/1956 | United Kingdom | 49/350 |

*Primary Examiner*—Peter A. Aschenbrenner
*Assistant Examiner*—Gerald A. Anderson
*Attorney, Agent, or Firm*—Wegner & Bretschneider

[57] ABSTRACT

The window regulator for lifting or pulling down a window glass of an automobile is of the arm type. The arm of the window regulator is connected to the window glass through a hinge mounted on a rotation axis extending in the widthwise (front/rear) direction of the window glass. This arrangement allows the arm of the window regulator to rotatably move on the rotation axis of the hinge in relation to the window glass, thereby leading to the smooth upward or downward movement of the window glass.

9 Claims, 5 Drawing Sheets

VEHICLE DOOR APPARATUS

BACKGROUND OF THE INVENTION

1. Field of the Invention

The present invention relates to a vehicle door apparatus and, more particularly, to a vehicle door apparatus consisting of a window regulator for lifting and pulling down a window glass, which is of an arm type of which the top end portion of the arm is connected to the bottom portion of the window glass.

2. Description of the Prior Art

As a vehicle door apparatus for lifting or pulling down a window glass in a door of an automobile is exemplified a window regulator of a so-called arm type for lifting or pulling down a window glass. More specifically, the window regulator of the arm type is provided with an arm that is rotatably moved in accordacnce with the operation of an operator. In this type of the window regulator, the arm is generally connected to a guide member mounted at the bottom portion of the window glass. The guide member is arranged to extend in the lengthwise direction or in the direction from the front to rear end portions of the window glass and to guide the top end portion of the arm in the lengthwise direction of the window glass. With this arrangement, the end portion of the arm is allowed to move in the lengthwise direction by the guidance with the guide member in accordance with the rotation of the arm constituting the window regulator, thereby lifting or pulling down the window glass.

Accordingly, in order to allow the window regulator of the arm type to smoothly lift or pull down the window glass, it is necessary that the top end portion of the arm is construsted so as to smoothly move by the guidance of the guide member.

Japanese Utility Model Application Laid-Open No. 191,618/1982 discloses a vehicle door apparatus with a window regulator of the arm type, which is shown to have a connection structure between an arm and a window glass. In this structure, a bottom guide channel extending in the lengthwise (front side - rear side) direction of the window glass is fixed to the bottom end portion of window glass. The top end portion of the arm is arranged so as to face the bottom guide channel, and a pin extending in the direction intersecting at right angle to a plate surface of the window glass is fixed to the top end portion of the arm and arranged within the bottom guide channel.

Accordingly, in order to allow the arm of the window regulator to smoothly move in the bottom guide channel in conventional window regulator, it is necessary to ensure that the facing arrangement between the top end portion of the arm and the bottom guide channel, i.e., the window glass, is always in parallel and, specifically, to lift or pull down the window glass so as not to vary the direction of the bottom end portion of the window glass. In other words, it is necessary to arrange the window glass to be lifted or pulled down in such a manner that the locus of movement of the bottom end portion of the window glass is straight in the upward-downward direction.

Recently, a window glass having a curved surface has been more frequently employed for doors of an automobile. Accordingly, if a curved-surface window glass is lifted or pulled down while keeping the direction of the bottom end portion of the window glass in one direction, it is necessary to broaden the width of a space for accommodating the window glass formed by an inner door panel and outer door panel, i.e., the thickness of a door, in accordance with enlargement of a curvature of a window glass.

SUMMARY OF THE INVENTION

Therefore, the present invention has a major object to provide a vehicle door apparatus enabling a window glass to be lifted or pulled down smoothly even if a window glass with a largely curved surface is employed.

The present invention has another object to provide a vehicle door apparatus that enables a force required for the operation for lifting or pulling down a window glass to be rendered small as well as ensures the smooth upward or downward movement of a window glass with a largely curved surface.

The present inventinn has a further object to provide a vehicle door apparatus that prevents an interference of a guide rail for guiding the upward or downward movement of a window glass with the window glass as well as ensures the smooth upward or downward movement of a window glass with a largely curved surface.

The present invention is fundamentally achieved by the arrangement defined and claimed in claim 1. In summary, a window regulator is disposed in a manner that an arm of the window regulator is connected through a hinge member to the bottom end portion of the window glass and a rotating axis of the hinge member is arranged to extend in the lengthwise direction of the window glass.

With this arrangement, the arm of the window regulator and the window glass are allowed to pivotably move at the center of the rotation axis extending in the lengthwise direction of the window glass. As a result, if the direction of the bottom end portion of the window glass varies with the upward or downward movement of the window glass, such a directional variation can be absorbed by the hinge member. Accordingly, if a window glass with a largerly curved surface is employed, the vehicle door apparatus of the present invention ensures the smooth upward or downward movement of the window glass without giving an excessive force on a connection between the arm of the window regulator and the window glass.

In accordance with the present invention, the guide rail for guiding the upward or downward movement of the window glass is preferably mounted so as to face the side surface of the window glass in order to prevent an interference with the plate surface of the window glass. In particular, it is desirable to provide the side surface of the bottom end portion of the window glass with a roller extending outward so as to permit a movement along the guide rail, whereby the upward or downward movement of the window glass is all the more rendered smooth. The guide rail is also arranged to regulate the locus of movement resulting from the upward or downward movement of the bottom end portion of the window glass. Accordingly, when a window glass with a largely curved surface is employed, it is desired to use a guide rail in the form bulged outward, thereby enabling the thickness dimension of the window glass accommmodating space formed in the door to be rendered small.

The window regulator to be used in the present invention is preferably arranged such that a mechanism for transmitting an operation force is composed of gear train comprising an input gear and an output gear engaged therewith. The output gear has a radius larger than that of the input gear, thereby enabling a force of operation to be rendered small. The axis portion of the output gear is integrally mounted on the base end portion of the arm. With this arrangement, the force for the operation of the window regulator can be minimized. And the number of teeth of the output gear, as a mater of course, is satisfactory enough if is can at the minimum lift or pull down the window glass.

The connection of the bottom end portion of the window glass to the arm of the window regulator is preferably composed of a combination of a bottom guide rail mounted on the bottom end portion of the window glass with a roller mounted on the top end portion of the arm. The top end portion of the arm is a arranged to slidably move along the bottom end portion of the window glass in a smooth way. It is particularly preferable to provide the bottom wall of the bottom guide rail with a long hole extending in the lengthwise direction. Into the long hole is inserted a pin that in turn is inserted through the top end portion of the arm and the roller mounted on the top end portion thereof, and the both ends of the pin are designed to have enlarged heads, thereby preventing the roller from slipping off from the arm and the bottom guide rail. With this arrangement, the assembly of these elements can be made merely by calking the end portions of the pin, whereby the assembly work of mounting the roller within the bottom guide rail is rendered easy and simple.

In accordance with the present invention, the hinge member is arranged to be interposed at least between the top end portion of the arm and the bottom end portion of the window glass, i.e., between the elements connecting the arm and the window glass. More specifically, the hinge member may be mounted between the bottom guide rail and the window glass or disposed in such a manner that surfaces with which the bottom guide rail comes in contact with the roller mounted within the bottom guide rail are in the form of a circular arc having the rotation center of the roller as a center. The hinge member may also be interposed between the bottom guide rail and the window glass or arranged each at the both ends of the bottom guide rail in order to minimize a number of hinge members. In this arrangement, it is preferred to provide a coupling member extending in the thickness direction of a door between the hinge member and the bottom guide rail in order to supply a room or margin therebetween. This can lead to the minimization of a variation in the bending tranformation of the arm. It is also preferred to interpose a bottom holder between the hinge member and the window glass, thereby preventing the window glass from breaking.

Other objects and advantages of the present invention will become apparent during a course of description of the following examples by referring to the accompanying drawings.

BRIEF DESCRIPTION OF DRAWINGS

FIG. 1 is a longitudinal sectional view showing a side door.

FIG. 2 is a view illustrating an apparatus for lifing or pulling down a window glass in a side door.

FIG. 3 is a III—III senctional view if FIG. 2, illustrating a guide mechanism of a window glass.

FIG. 4 is a partially enlarged, diagonal view, illustrating a connection of an arm of a window regulator to a window glass.

FIG. 5 is a V—V senctional view of FIG. 2 illustrating a connection of the top end portion of the arm to a bottom guide rail.

FIG. 6 is a VI—VI sectional view of FIG. 4, illustrating a construction of the bottom guide rail connected to the window glass.

FIG. 7 is a view showing components of a hinge member.

FIG. 9 is a sectional view illustrating the construction of the bottom guide rail connected to the window glass, and FIG. 10 is a partially sectional view illustrating a roller mounted on the top end portion of the arm through a hinge menber.

DETAILED DESCRIPTION OF THE PREFERRED EMBODIMENT

FIGS. 1 through 7 are a description of the first embodiment of the vehicle door apparatus in accordance with the present invention.

Figure 1:
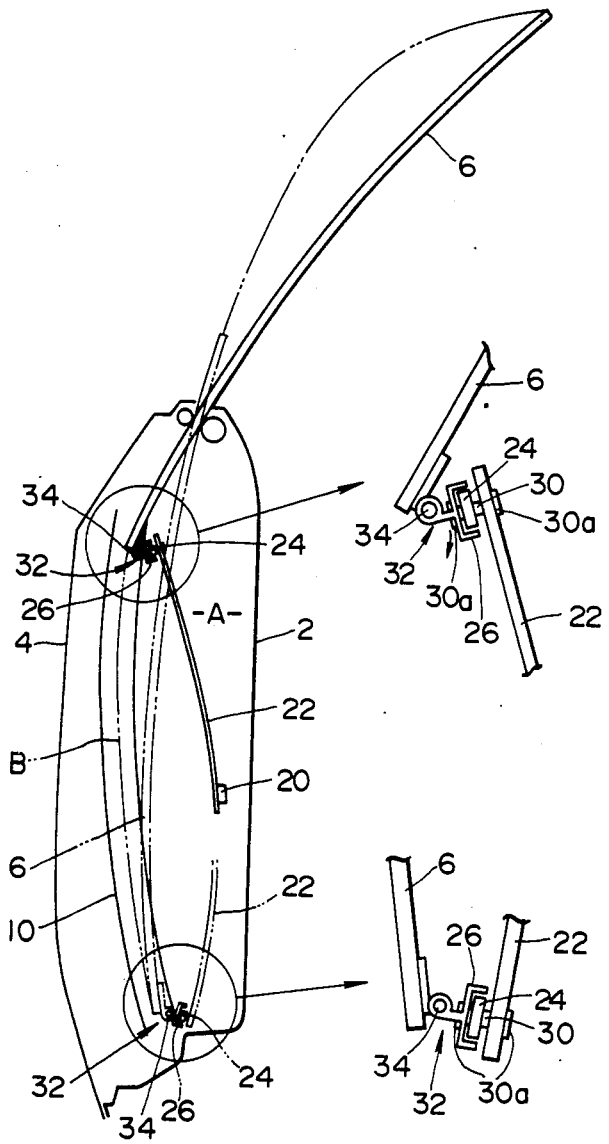
FIGS. 1 through 7 illustrates the first embodiment in accordance with the present invention.
Figure 2:
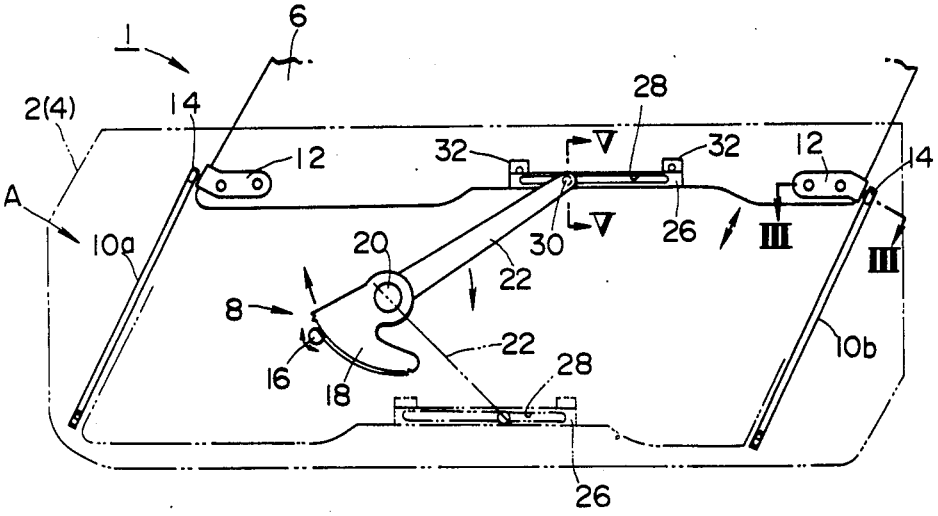
Figure 3:
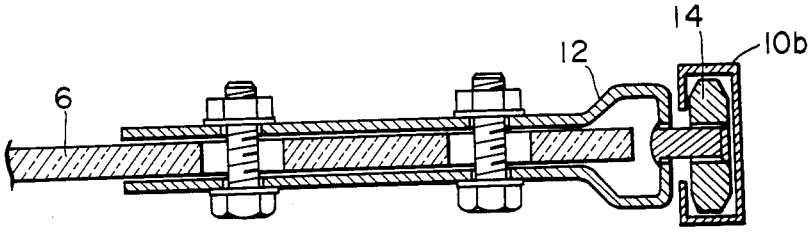
Figure 6:
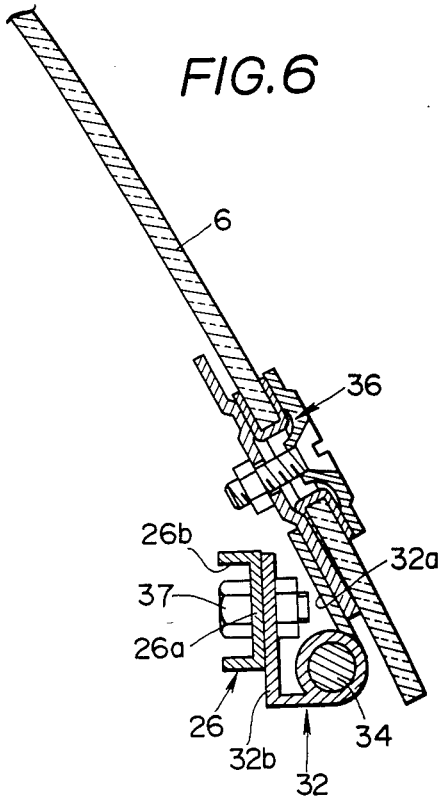

Referring to FIG. 1 and 2, a side door 1 is provided with an inner space A formed by and limited between an inner door panel 2 and an outer door panel 4. The inner space A is arranged to accommodate a window glass 6, a window regulator 8 for lifting or pulling down the window glass 6, and a pair of guide rails 10 (10*a*, 10*b*) for guiding the upward or downward movement of the window glass 6. In this arrangment is employed a window glass having a surface largely curved outward as the window glass 6 so that the guide rails 10*a* and 10*b* are mounted so as to face the both side portions, i.e., the front end surface and the rear end surface of the window glass 6. Each of the guide rails 10*a* and 10*b* is designed to have an opening facing each the side surfaces of the window glass 6. The bottom end portion of the window glass 6 is provided at the front end and rear end portions thereof each with a roller 14 through a fixing member 12. The roller 14 is arranged so as to project outward each from the both end side surfaces, i.e., the front end side surface and rear end side surface of the window glass 6, and accommodated within a guide rails 10, as shown in FIG. 3. Each of the guide rails 10 is in a form curved toward from a vehicle cabin, as shown in FIG. 1, and is arranged so as to guide the window glass 6 for the upward or downward movement in the inner space A as drawing a curved line of movement as indicated by B.

In this arrangement, the window glass 6 is lifted or pulled down as drawing a line B curved toward the outside of the door in a accordance with the guidance by the guide rails 10 without interference with the guide rails 10.

Turning to FIG. 2, the window regulator 8 is constructed so as to allow an input gear 16 mounted integrally with an input axis (not shown) to engage with an output gear 18. A rotating shaft 20 of the output gear 18 is integrally mounted with an arm 22 as an output member. In this arrangement according to the present invention, a mechanism of transmitting an operating force is composed of a gear train consisting of the input gear 16 and the output gear 18 engaged therewith. The output gear 18 has a radius larger than that of the input gear 16. The arm 22 is constructed so as to rotate on the axis of the rotating shaft 20 through the output gear 18 by the manual or electrical rotation of the input gear 16 via the driver's operation. The arm 22 is connected to the window glass 6, as described hereinafter, and arranged so as to lift or pull down the window glass 6 in accordance with the pivotal movement of the arm 22.

Accordingly, a force for the operation of the window regulator 8 can be minimized on account of a combination of the output gear 18 having a larger radius with the input gear 16 having a smaller radius, and the number of teeth of the output gear 18 is satisfactory enough if it could lift or pull down the window glass 6.

Figure 4:
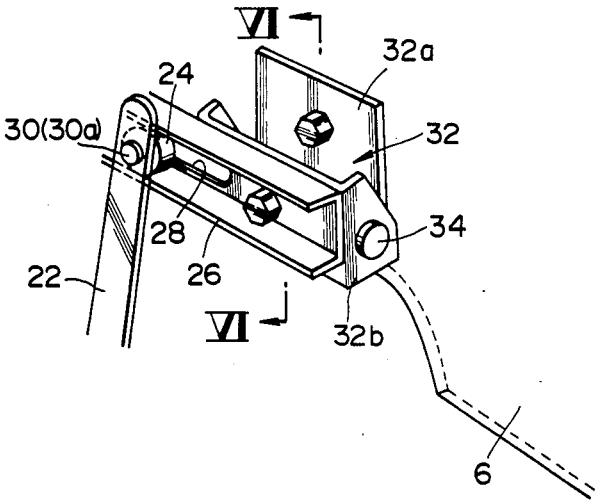

The arm 22 is of a plate form, as shown in FIG. 4, and constructed so as to permit a slightly bending deformation in the thickness direction of the door. A roller 24 is mounted rotatably at the top end portion of the arm 22 and accommodated within a bottom guide rail 26 mounted on the bottom end portion of the window glass 6, as shown in FIG. 5.

Figure 5:
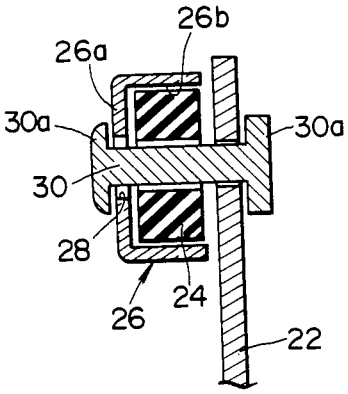
Figure 7:
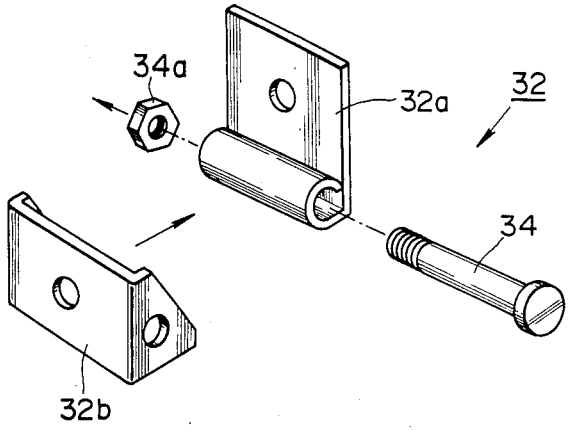

As shown in FIG. 5, the bottom guide rail 26 is in the square C-letter form in the cross section and is provided such that the bottom wall 26*a* faces the glass surface of the window glass 6, extending in the lengthwise (front side-rear side) direction of the window glass 6. The bottom wall 26*a* of the window glass 6 is provided with a long hole 28 extending in the lengthwise direction, and a pin 30 inserting through the arm 22 and the roller 24 is inserted in the long hole 28. The pin 30 is provided each with an enlarged head 30*a* at the both ends, in such a manner that the roller 24 does not slip off from the bottom guide rail 26.

One of the enlarged heads 30*a* may be formed by calking, i.e., by inserting the pin 30 through each of the elements 22, 26 (28), and 24 and then calking one of the end portions of the pin 30, thereby leading to a connection of the arm 22 to the bottom guide rail 26. This makes the assembly work of the roller 24 into the bottom guide rail 26 easy and simple.

Turning now to FIG. 4, the bottom guide rail 26 is shown to be mounted on the window glass 6 through a hinge member 32 arranged at the both end potions thereof. The hinge member 32 is disposed so as to rotate on a rotation axis 34 extending in the widthwise direction or in the direction from the front to rear end side portions of the window glass 6. As specifically shown in FIGS. 6 and 7, the hinge member 32 is composed of a pin constituting the rotation axis 34, and elements 32*a* and 32*b* connected rotatably to the pin 34, and the pin 34 is threaded at its one end portion so as to be fastened with a nut 34*a*. The element 32*a* is mounted to the window glass 6 through a bottom holder 36 and fastened to the bottom wall 26*a* of the bottom guide rail 26 with a bolt 37. With this arrangement, the bottom guide rail 26 can rotate on the axis of the rotation shaft (pin) 34, i.e., on the rotation axis of the hinge member 32 extending along the bottom end portion of the window glass 6 as the center of rotation.

This arrangement allows the roller 24 to rotatively move in the bottom guide rail 26 in accordance with a positional variation of the arm 22 with the operation of an operator, leading the top end portion of the arm 22 to move along the bottom end portion of the window glass 6 while lifting or pulling down the window glass 6. In this instance, the bottom end portion of the window glass 6 is shown to be lifted or pulled down via the guidance by the guide rail 10 as drawing the locus of movement as indicated by the curved line B, as shown in FIG. 1.

In this arrangement, the bottom end portion of the window glass 6 is disposed so as to vary its direction with the upward or downward movement of the window glass 6 and, correspondingly, a variation in angles at which the window glass 6 faces the arm 22 is absorbed by the hinge member 32. Thus, parallel relationship of the guiding surface (side wall) 26*b* with the axis of the roller 24 can be always maintained merely with a slightly bending variation in the form of the arm 22.

Accordingly, the roller 24 can rotatively move in the bottom guide rail 26 in a smooth manner, thereby ensuring the smooth upward and downward movement of the window glass 6. And the window glass 6 having a surface largely curved outward can move in an upward or downward direction as drawing the locus of movement as indicated by a curved line B so that the width of the inner space A, i.e., a distance of the inner door panel 2 and the outer door panel 4, can be rendered relatively narrow, thereby enabling the window glass 6 with a relatively large curvature to be accommodated in the door without enlarging the thickness of the door 1.

FIGS. 8 through 11 illustrate other embodiments of the vehicle door apparatuses in accordance with the present invention. In these figures, elements having the functions identical or similar to those used in the first embodiment as described hereinabove will be indicated by the identical reference numerals and description on these elements will be omitted hereinafter. A description which follows will be made particularly on the characteristic aspects of the embodiments other than the first embodiment described above.

Figure 8:
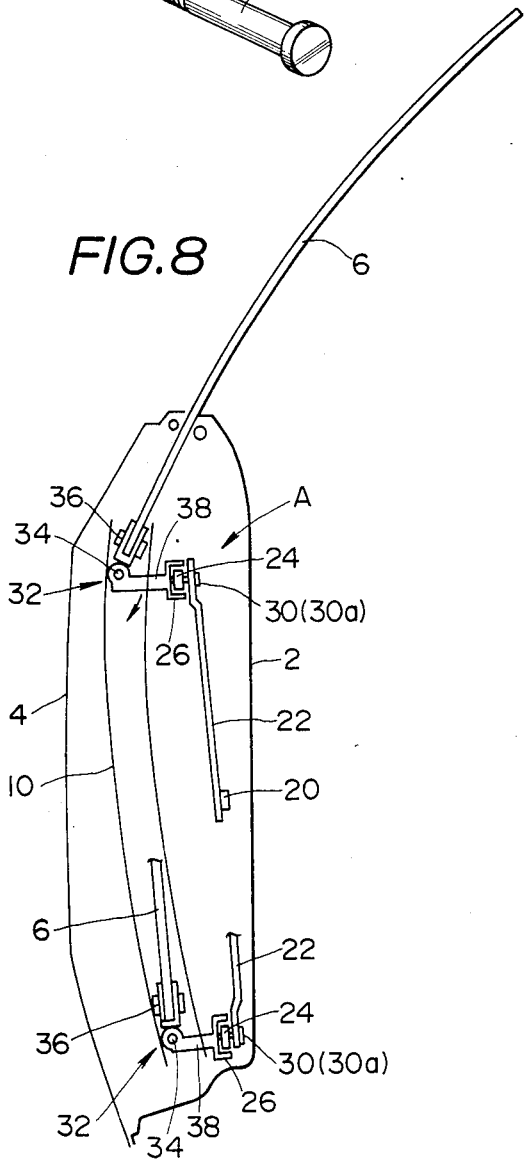
FIG. 8 is a longitudinal sectional view illustrating the inner structure of a door for the second embodiment of the present invention.

Turning now to FIG. 8 that illustrates the second embodiment of the vehicle door apparatus in accordance with the present invention, the hinge member 32 is provided with a connection 38 extending in the inward direction of the door, and the bottom guide rail 26 is mounted on the top end portion of the hinge member 32. The bottom guide rails 26 are positioned at a space on the inner side surface of the window glass 6 so that the bending deformation of the arm 22 resulting from the upward or downward movement of the window glass 6 can be minimized.

Figure 9:
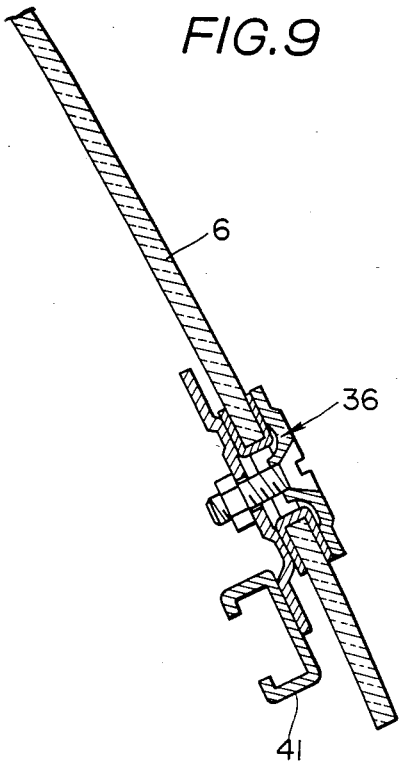
FIGS. 9 and 10 illustrate the third embodiment of the present invention.
Figure 10:
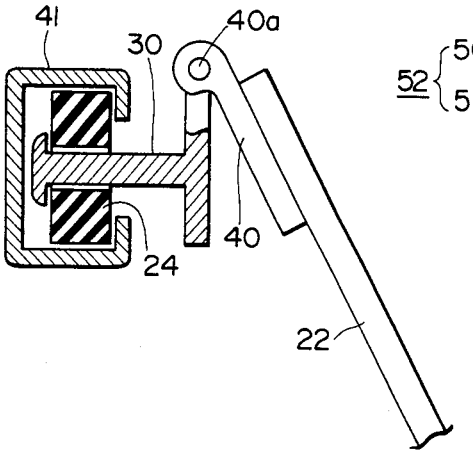

FIG. 9 and 10 illustrate the third embodiment of the vehicle door apparatus in accordance with the present invention. The arm 22 of a window regulator is connected through a hinge 40 to a bottom guide rail 41 fixed to the window glass 6, i.e., the hinge 40 is fixed to the top end portion of the arm 22 so as to rotate on a rotation shaft 40*a* extending in the lengthwise direction of the window glass 6. The roller 24 is arranged so as to move within the bottom guide rail 41.

Figure 11:
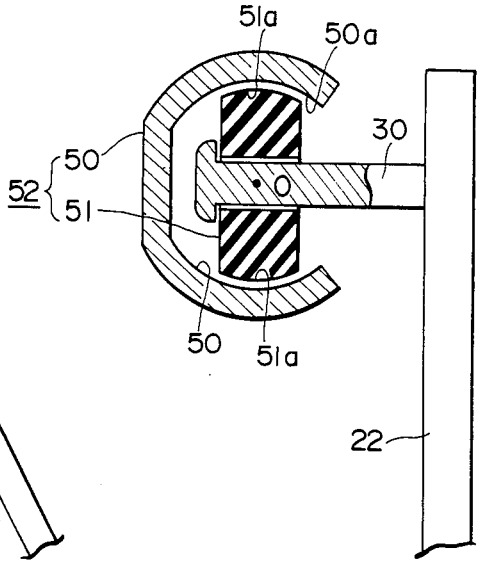
FIG. 11 is a partially enlarged, sectional view illustrating the fourth embodiment of the present invention.

FIG. 11 illustrates a hinge member in another embodiment of the vehicle door apparatus according to the present invention. In this embodiment, a hinge member 52 is composed of a bottom guide rail 50 and roller 51, i.e., the bottom guide rail 50 is fixed to a window glass (not shown) in the same manner as in the third embodiment as shown in FIG. 9 and constructed so as to accommodate the roller 51 within the inside thereof. The inner portion of the bottom guide rail 50 is designed such that its surface 50*a* coming into contact with the surface 51*a* of the roller 51 is in the form of a circular arc having rotation center O in common with that of the roller surface 51*a*.

The embodiments of the vehicle door apparatus in accordance with the present invention are not limited to those illustrated hereinabove. The bottom guide rail 26 may be designed so as to comprise a guide channel having a long hole extending in the lengthwise direction. And the arm 22 may be provided at its top end portion with a pin such a manner that the pin is inserted in the guide channel.

The present invention is not intended in any manner to be limited to the embodiments as described hereinabove, and it is to be understood that any variations or modifications made so as not to deviate from the basic concepts of the present invention are interpreted as being contained within the spirit of the present invention.

What is claimed is:

1. A vehicle door apparatus comprising:

a window glass arranged so as to be slidably lifted or pulled down in a window glass accommodating space inside a door, said window glass having a front end surface and a rear end surface;

first and second guide rails for guiding the upward and downward movement of the window glass, said guide rails being mounted so as to face the front and rear end surfaces of said window glass at a space therefrom and each having a restricted length within the window glass accommodating space;

a first window glass transferring member and a second window glass transferring member arranged so as to support lower portions of the front and rear end surfaces and move slidably and vertically along inner surfaces of the first and second guide rails respectively while lifting or pulling down the window glass, said first window glass transferring member being mounted on the lower end portion of said window glass which projects from the front end surface thereof and said second window glass transferring member being mounted on the lower end portion of said window glass which projects from the rear end surface thereof;

a window regulator for lifting or pulling down said window glass, comprising an arm rotatably movable within said window glass accommodating space, a top end portion of said arm being connected to a bottom end portion of the window glass so as to be movable in a lengthwise direction of the window glass; and a hinge member having a rotation axis extending in the lengthwise direction of the window glass, said hinge member being positioned between the top end portion of said arm and the bottom end portion of the window glass.

2. A vehicle door apparatus as claimed in claim 1, wherein said window regulator further comprises an output gear which is engageable with an input gear, said output gear having a radius larger than that of the input gear and being integrally mounted to a base end portion of said arm.

3. A vehicle door apparatus as claimed in claim 1, wherein said first and second window glass transferring members comprise first and second rollers, respectively, said rollers being mounted on a bottom portion of the end portion of the window glass, said first and second guide rails having openings which receive the first and second rollers so as to permit sliding movement.

4. A vehicle door apparatus as claimed in claim 1, wherein said hinge member has a connection portion extending in the widthwise direction.

5. A vehicle door apparatus as claimed in claim 1, wherein said guide rails are curved in a convex manner within the door.

6. A vehicle door apparatus as claimed in claim 5, further comprising a first roller mounted on the bottom end portion of said window which projects from the front end surface thereof and a second roller mounted on the bottom end portion of said window glass which projects from the rear end surface thereof, said first and second rails having openings which receive the first and second rollers.

7. A vehicle door apparatus as claimed in claim 5, wherein said hinge member has a connection portion extending in the widthwise direction.

8. A vehicle door apparatus as claimed in claim 1, further comprising:

a bottom guide rail mounted to the bottom end portion of window glass which extends in the lengthwise direction of the window glass;

a roller rotatably provided at the top end portion of said arm, said roller being accommodated within said bottom guide rail;

wherein said hinge member is arranged between said roller and said arm.

9. A vehicle door apparatus as claimed in claim 8, wherein said hinge member mounted between said window glass and said bottom guide rail has a connection portion extending in the widthwise direction and said bottom guide rail is mounted at the inner end portion of said connection portion.

* * * * *